US008547407B2

(12) United States Patent
Chiou et al.

(10) Patent No.: US 8,547,407 B2
(45) Date of Patent: Oct. 1, 2013

(54) BACKLIGHT CONTROL METHOD AND APPARATUS FOR HIGH BRIGHTNESS CONTRAST IMAGES

(75) Inventors: Ye-long Chiou, Cupertino, CA (US); Futoshi Hayashida, San Jose, CA (US)

(73) Assignee: Synaptics Incorporated, San Jose, CA (US)

( * ) Notice: Subject to any disclaimer, the term of this patent is extended or adjusted under 35 U.S.C. 154(b) by 400 days.

(21) Appl. No.: 12/898,311

(22) Filed: Oct. 5, 2010

(65) Prior Publication Data

US 2012/0081407 A1 Apr. 5, 2012

(51) Int. Cl.
*G09G 5/10* (2006.01)

(52) U.S. Cl.
USPC ..... 345/690; 345/77; 345/89; 345/102

(58) Field of Classification Search
USPC ..... 345/204, 690, 87–104, 76–83, 60
See application file for complete search history.

(56) References Cited

U.S. PATENT DOCUMENTS

2005/0140631 A1* 6/2005 Oh et al. ..... 345/89
2005/0212825 A1* 9/2005 Lee et al. ..... 345/690
2007/0024573 A1* 2/2007 Kamimura ..... 345/102

* cited by examiner

*Primary Examiner* — Stephen Sherman
(74) *Attorney, Agent, or Firm* — Osha Liang LLP

(57) ABSTRACT

An apparatus and method for providing backlight control for high brightness contrast images is provided. The apparatus and system can classify images to be displayed on a display device according to their intensity characteristics. The apparatus and system can also adjust a backlight control signal based on the image's classification, such that optimal backlight control can be achieved whether of not the image is a high brightness contrast image.

19 Claims, 5 Drawing Sheets

BACKLIGHT CONTROL METHOD AND APPARATUS FOR HIGH BRIGHTNESS CONTRAST IMAGES

BACKGROUND

1. Technical Field

The present disclosure relates generally to backlight control for flat panel displays, such as liquid crystal displays, and more particularly, to a backlight control system and method for detecting and balancing high brightness contrast images.

2. Discussion of Related Art

Display devices often have a liquid crystal display for displaying images. Since liquid crystal displays (LCDs) do not emit light, LCDs display images by receiving light from a backlight section (or assembly) of the display device. The backlight section uses a light source (or lamp) to provide light to the LCD. The light source can include cold cathode fluorescent lamps (CCFLs), external electrode fluorescent lamps (EEFLs), hot-cathode fluorescent lamps (HCFLs), flat fluorescent lamps (FFLs), light-emitting diodes (LEDs), or combinations thereof. Dimming methods are implemented to control the amount of light the backlight section outputs to the LCD to enhance image quality and conserve power. For example, the display device can include an inverter that applies a dimming signal to the backlight section, thereby controlling the backlight section's brightness (light output). The inverter may use a pulse width modulation (PWM) method to repeatedly turn the backlight section's light source on and off according to a duty ratio of the dimming signal. A general dimming algorithm typically determines the duty ratio (also referred to as a dimming ratio), despite characteristics of the image to be displayed on the display device. The general dimming algorithm provides adequate brightness levels for general images, however, it often provides poor dimming quality for high brightness contrast images. For example, the dimming ratio determined by general dimming algorithms for high brightness contrast images is often too aggressive, resulting in poor dimming quality, or too conservative, resulting in poor power savings. Accordingly, although existing approaches for controlling brightness of a display device's backlight section have been generally adequate for their intended purposes, they have not been entirely satisfactory in all respects.

SUMMARY

Consistent with embodiments of the present disclosure, a method for determining characteristics of an image to be displayed on a display device is provided. The method can include determining a pixel intensity distribution of the image; determining a first intensity characteristic of the image from the pixel intensity distribution; determining a second intensity characteristic of the image from the pixel intensity distribution; and determining a difference between the first and second intensity characteristics. If the difference is greater than or equal to a threshold value, the image is classified as a high brightness contrast image.

Consistent with embodiments of the present disclosure, a backlight control method is provided. The method can include determining a pixel intensity distribution of an image to be displayed on a display device; determining a first intensity characteristic of the image from the pixel intensity distribution; determining a second intensity characteristic of the image from the pixel intensity distribution; and determining a difference between the first and second intensity characteristics. If the difference is less than a threshold value, a backlight control signal is generated, such that the backlight section outputs light according to the backlight control signal. If the difference is equal to or greater than the threshold value, an adjusted backlight control signal is generated, such that the backlight section outputs light according to the adjusted backlight control signal.

Consistent with embodiments of the present disclosure, an apparatus is provided that includes a display section for displaying an image; a backlight section for outputting light to the display section; and a backlight control section in communication with the backlight section, such that the backlight section outputs light according to a backlight control signal. The backlight control section can be configured to implement the method for determining characteristics of the image to be displayed on the display device and/or the backlight control method.

These and other embodiments will be described in further detail below with reference to the following figures.

BRIEF DESCRIPTION OF THE DRAWINGS

The teachings of the embodiments described herein can be readily understood by considering the following detailed description in conjunction with the accompanying drawings.

DETAILED DESCRIPTION OF THE DRAWINGS

The following description sets forth specific details describing various embodiments. It will be apparent to one skilled in the art that the disclosed embodiments may be practiced without some or all of these specific details. The specific embodiments presented are meant to be illustrative, but not limiting. One skilled in the art may realize other material that, although not specifically described herein, is within the scope and spirit of the present disclosure.

Figure 1:
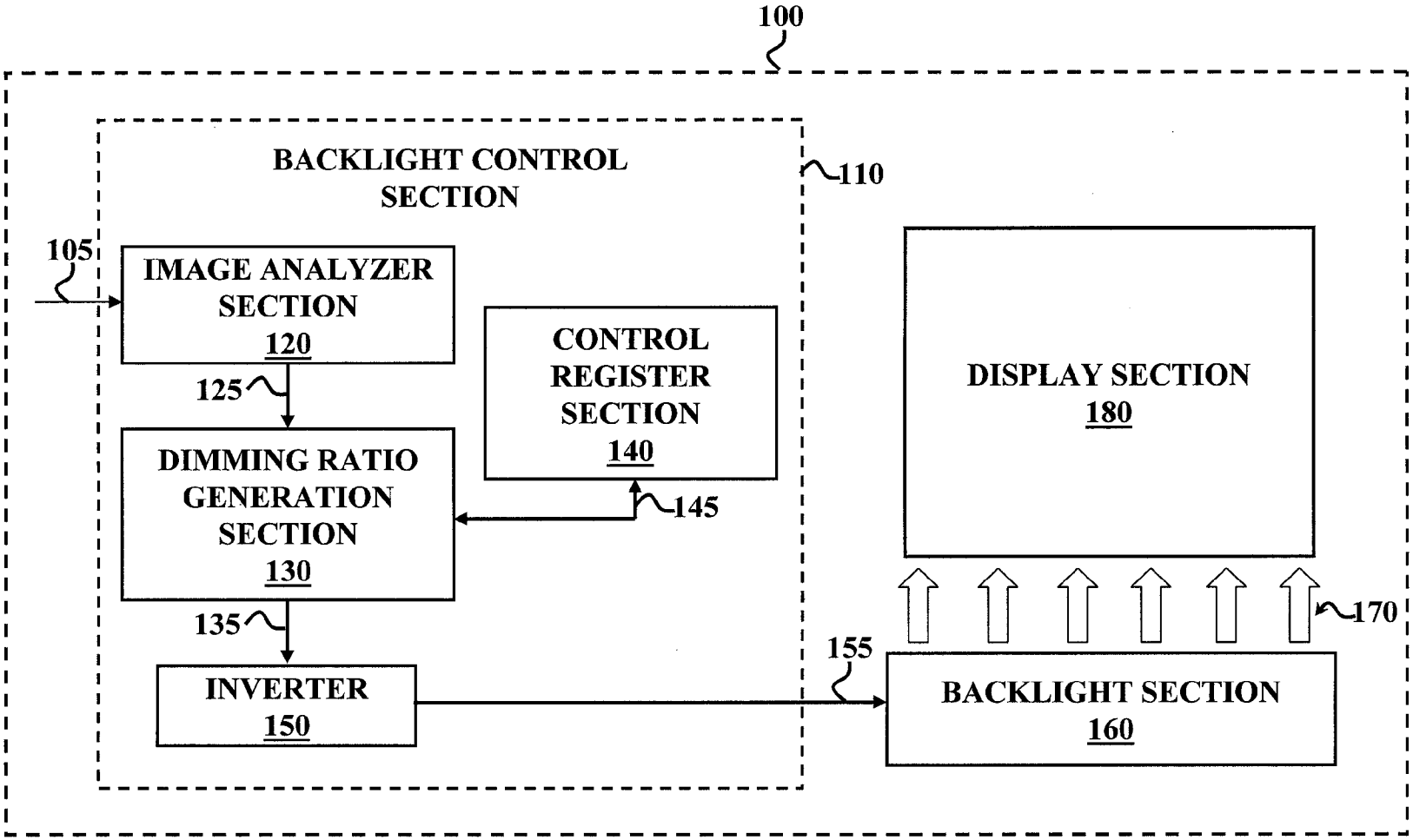
FIG. 1 is a block diagram of an apparatus that is a display device that embodies various aspects of the present disclosure.

FIG. 1 is a block diagram of a display device 100. In the depicted embodiment, the display device 100 is a flat panel display device, particularly a liquid crystal display (LCD) device. Alternatively, the flat panel display device could be another flat panel display device. FIG. 1 is not a comprehensive diagram of the entire display device 100. Instead, for simplicity and clarity, FIG. 1 shows only selected portions of the overall apparatus that facilitate an understanding of aspects of the present disclosure.

The display device 100 includes a backlight control section 110. As will be described in detail below, the backlight control section 110 classifies images and adjusts a backlight control signal depending on how the image is classified. In the depicted embodiment, the backlight control section 110 includes an image analyzer section 120, a dimming ratio generation section 130, a control register section 140, and an inverter 150. The image analyzer section 120 receives an image signal 105 that includes data associated with an image to be displayed by the display device 100. The image analyzer section 120 derives pixel intensity distribution information associated with the image from the image data, and provides the pixel intensity distribution information via output 125 to the dimming ratio generation section 130.

The dimming ratio generation section 130 receives and analyzes the pixel intensity distribution information to determine a dimming ratio signal (alternatively referred to as a backlight control signal) necessary to control backlight of the image. More specifically, based on the pixel intensity distribution information, the dimming ratio generation section 130 classifies the image and determines the appropriate dimming ratio signal based on the image's classification. In the depicted embodiment, the dimming ratio generation section 130 communicates with the control register section 140 via interface 145 to determine the dimming ratio signal. For example, the control register section 140 includes not illustrated registers for storing information used to determine the dimming ratio signal, such as a bright region limit register, a high brightness contrast limit register, and a compensation value register. In the depicted embodiment, the control register section 140 is programmable, and thus, the not illustrated registers are programmable registers so that the values stored in each register may be modified to desired values, when necessary. Alternatively, the registers could be included elsewhere in the display device 100.

The dimming ratio generation section 130 outputs the dimming ratio signal 135 to control the inverter 150, and the inverter 150 outputs a backlight control signal 155 to control a light source driving power of a backlight section 160 of the display device 100. For example, the inverter 150 sets a backlight parameter according to the dimming ratio signal 135. In the depicted embodiment, the inverter 150 sets a pulse width modulation (PWM) signal. For example, the inverter 150 sets a backlight duty ratio (backlight control signal 155) to be applied to the backlight section 160 according to the dimming ratio signal 135 received from the dimming ratio generation section 130. When the backlight duty ratio is high, for example, 100%, the backlight section 160 is completely on. When the backlight duty ratio is low, for example, 0%, the backlight section 160 is completely off. As the backlight duty ratio changes, the brightness of the backlight section 160 changes. For example, as the backlight duty ratio increases (in other words, as a current amount per unit hour supplied to the backlight section 160 increases), light output from the backlight section 160 increases, and vice versa. As will be apparent in the discussion below, in the depicted embodiment, the value of the dimming ratio control signal 135 (backlight control signal) is the same value as the backlight control signal 155. Accordingly, the dimming ratio control signal 135 and backlight control signal 155 can collectively be referred to as the backlight control signal.

The backlight section 160 illuminates a display section 180, such as a LCD display panel, with light 170 so that the display section 180 can display the images associated with the image data provided by image signal 105. For example, the backlight section 160 is arranged at a rear side of the display section 180, such that light 170 illuminates toward a front side of the display section 180. The backlight section 160 includes a light source (not illustrated) for illuminating the display section 180. In the depicted embodiment, the light source includes cold cathode fluorescent lamps (CCFLs). Alternatively or additionally, the light source includes external electrode fluorescent lamps (EEFLs), hot-cathode fluorescent lamps (HCFLs), flat fluorescent lamps (FFLs), light-emitting diodes (LEDs), other light sources, or combinations thereof.

Figure 2:
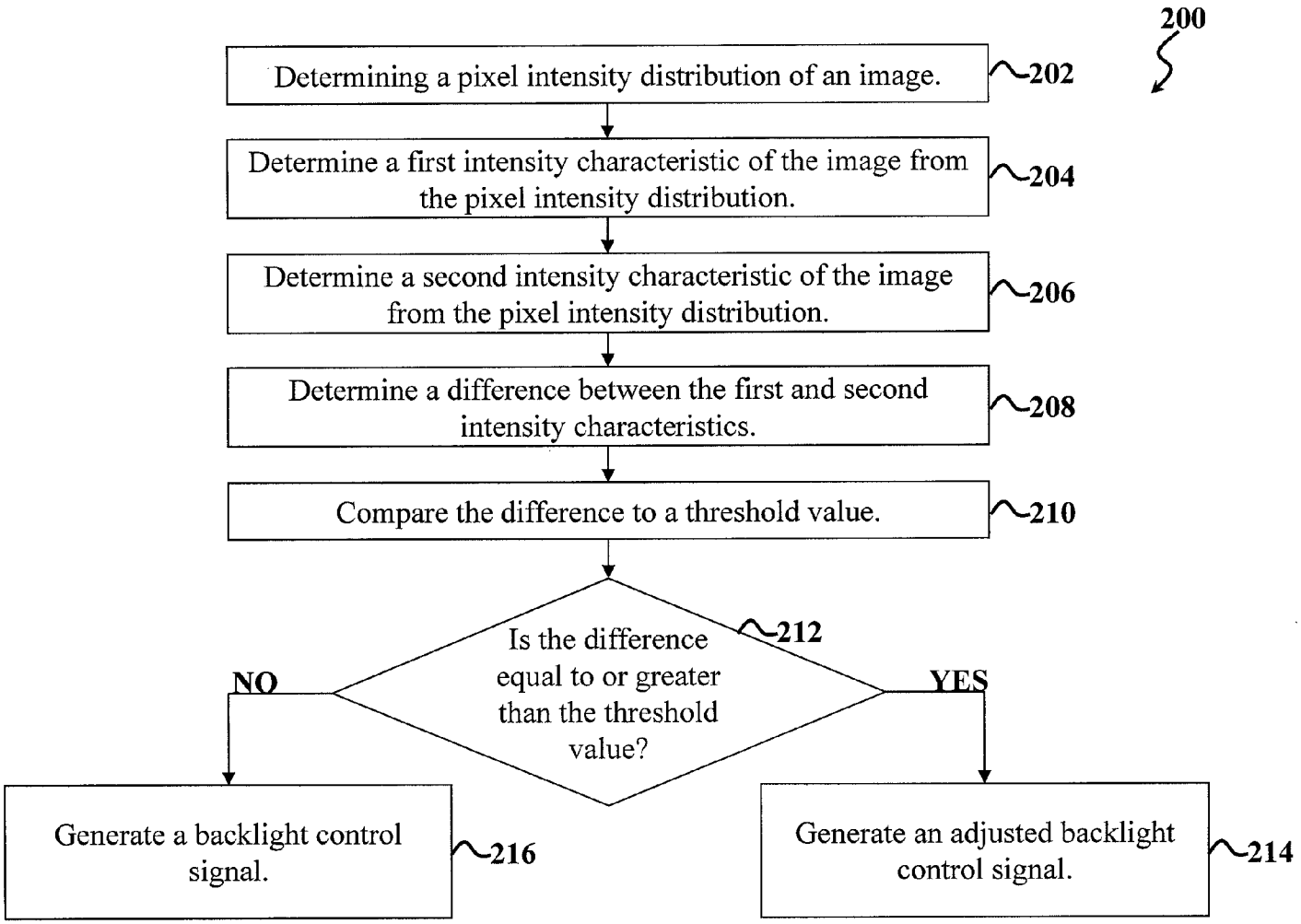
FIG. 2 is a flowchart of a method for providing backlight control that can be implemented by the display device of FIG. 1.

FIG. 2 is a flow chart of a method 200 for backlight control that can be implemented by the backlight control section 110 of the display device 100 in FIG. 1. The method 200 classifies an image to be displayed on the display device 100 based on the image's intensity characteristics, and generates a backlight control signal based on the image's classification. More specifically, in the depicted embodiment, the method 200 uses dual dimming ratios to detect high brightness contrast images and adjusts the backlight control signal accordingly. For simplicity and ease of discussion, the following discussion will be limited to using the method 200 to classify and adjust the backlight control signal with respect to a single image. However, it is understood that the display device 100 will receive multiple images to be displayed, and the method 200 is applied to each of the images, such that each of the images is classified, and the backlight control signal is appropriately adjusted based on each image's classification. Additional steps can be provided before, during, and after the method 200, and some of the steps described below can be replaced or eliminated for other embodiments of the method 200.

The method 200 begins at block 202 by determining a pixel intensity distribution of an image. In the depicted embodiment, the image analyzer section 120 of the display device 100 receives the image signal 105, which includes data associated with an incoming image to be displayed on the display section 180. The image analyzer section 120 derives pixel intensity distribution information related to the image from the data received via the image signal 105. More specifically, an image is made up of multiple pixels, and each pixel includes subpixels, such as red (R), green (G), and blue (B) subpixels. Data associated with the incoming image includes R, G, and B values for the subpixels of the incoming image. Brightness (also referred to as gray level) information of each pixel is determined from this data. In the depicted embodiment, the image analyzer section 120 analyzes the data from the image signal 105 and determines a brightness (gray) level of each pixel. The pixel brightness level is also referred to as a pixel intensity or pixel gray level. The brightness level for each pixel (pixel 1, pixel 2, pixel 3, . . . pixel N) of the image can be determined by determining a weighted sum of the R, G, and B values:

$$I_{pixel\ i}=(0.30\times R_i)+(0.59\times G_i)+(0.11\times B_i) \quad (1)$$

where $I_{pixel\ i}$ represents a brightness level of an ith pixel in the image, $R_i$ represents the red value for the ith pixel, $G_i$ represents the green value for the ith pixel, and $B_i$ represents the blue value for the ith pixel. Using Equation (1), the brightness level for pixel 1 through pixel N of the image is determined from each pixel's respective R, G, and B values. In the depicted embodiment, conventional weighting percentages are used in Equation (1), with R being weighted at 30%, G being weighted at 59%, and B being weighted at 11%. The conventional weighting percentages are based on each color's effect on the image's brightness. These weighting percentages are simply for illustration, and other percentages can be used to weight the R, G, and B values differently to obtain the weighted sum. Further, Equation (1) provides an exemplary algorithm for determining each pixel's brightness level. Alternatively, other algorithms may be used to determine each pixel's brightness level. For example, an average of the R, G, and B values of a pixel may represent the pixel's brightness level.

Figure 3:
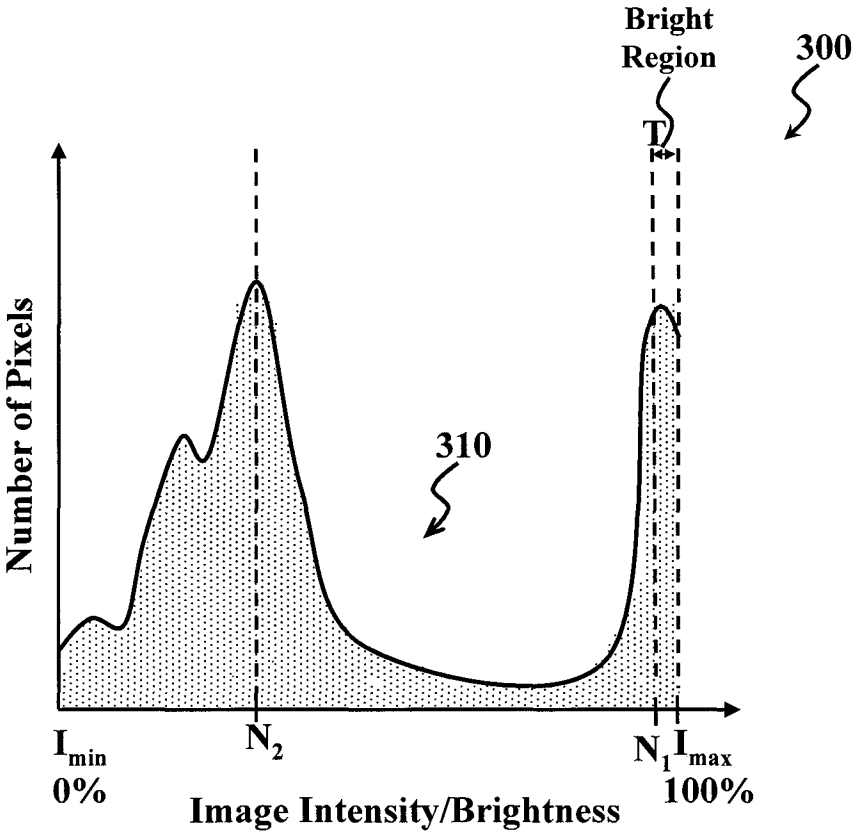
FIGS. 3-5 are image histograms that illustrate pixel intensity distributions of various images that can be generated, analyzed, and/or displayed by the display device of FIG. 1.

In the depicted embodiment, the image's brightness levels are recorded into an image histogram. FIG. 3 is an image histogram 300 showing a curve 310 that illustrates the pixel intensity distribution of the image (or put another way, a frequency of occurrence of each brightness level in the image). In FIG. 3, a horizontal axis represents intensity (brightness/gray level) values of the pixels in the image from a minimum value ($I_{min}$) to a maximum value ($I_{max}$). For example, in the depicted embodiment, the width of the image signal 105 is 8-bits wide, where the minimum intensity value is zero (brightness/gray level 0), and the maximum intensity value, i.e., maximum brightness, is 255 (brightness/gray level 255). The minimum intensity value can alternatively be referred to as being at 0% brightness, and the maximum intensity value can alternatively be referred to as being at 100% brightness, where each pixel corresponds with a brightness percentage. The vertical axis in FIG. 3 represents a number of pixels. Each point in the curve 310 indicates a number of pixels in the image at a respective brightness level. The histogram in FIG. 3 is provided for illustration purposes only. It is understood that the dimming ratio generation implemented by the dimming ratio generation section 130 can be performed solely with the data derived from the image signal 105, without generating graphical representations of the data, such as the image histogram 300 in FIG. 3.

At blocks 204 and 206, a first intensity characteristic of the image and a second intensity characteristic of the image are determined from the pixel intensity distribution. For example, the dimming ratio generation section 130 of the display device 100 receives the pixel intensity information from the image analyzer section 120 via output 125. In the depicted embodiment, the dimming ratio generation section 130 receives the pixel intensity distribution data associated with the image histogram 300. The dimming ratio generation section 130 analyzes the pixel intensity distribution data to determine the first and second intensity characteristics of the image.

In the depicted embodiment, the first intensity characteristic corresponds with a "bright" region of the pixel intensity distribution of the image. The "bright" region of the pixel intensity distribution is defined as the pixels of the image having the greatest brightness levels. It should be noted that the pixels having the greatest brightness levels will vary depending on each image's pixel intensity distribution, and thus, the pixels having the greatest brightness levels are relative to each image's pixel intensity distribution. In the depicted embodiment, the "bright" region of the pixel intensity distribution is defined by a bright region limit. The bright region limit is a programmable value that is stored in the bright region limit register (not illustrated) of the control register section 140. Since the bright region limit value is a programmable value, it can be set to any value. For example, the bright region limit can be defined as P % of the brightest image pixels. In the depicted embodiment, the bright region limit can be programmed to 5% of the brightest image pixels, however, other percentages (or values) are contemplated by the present disclosure. The bright region of the image's pixel intensity distribution thus includes 5% of the image pixels in the top brightness levels. For example, referring to the pixel intensity distribution data associated with the image histogram 300 in FIG. 3, the bright region of image histogram 300 is determined. More specifically, the dimming ratio generation section 130 scans the pixel intensity distribution from its most brightness level (here, $I_{max}$) to its least brightness level (here, 0%). From the scan, the dimming generation section 130 can determine a cumulative pixel value for the image (total number of pixels making up the image associated with image histogram 300). Then, using the bright region limit, the bright region of the image histogram 300 is defined as 5% of the cumulative pixels associated with the top brightness levels of the image. For example, starting at $I_{max}$ in FIG. 3, pixels are counted at each brightness level from 100%, 99%, 98%, and so forth until 5% of the cumulative pixels are counted. That point is indicated by dashed line T in FIG. 3. The pixels from point T to $I_{max}$ are referred to as the bright region of the image, which corresponds with the top brightest 5% of the image pixels. The first intensity characteristic is then defined as a lowest (minimum) brightness level of the bright region. For example, in the depicted embodiment, the brightness level corresponding with the minimum of the bright region, indicated by dashed line T, is $N_1$. For the sake of example, it is assumed that in the depicted embodiment $N_1$ is about 90%, and thus, the first intensity characteristic is about 90%.

The second intensity characteristic is determined by a method as known in the art or a future-developed method. For example, in the depicted embodiment, the second intensity characteristic is a ratio determined by a conventional backlight dimming algorithm. This ratio could also be used as a backlight dimming ratio to adjust the output of light 170 from the backlight section 160 to the display section 180. Accordingly, the second intensity characteristic can also be referred to as a second dimming ratio. In the depicted embodiment, the second intensity characteristic is determined by measuring the image's average brightness (gray) level from the pixel intensity distribution of the image. Put another way, the image's average brightness level estimates the center of an image's pixel intensity distribution. The average brightness level can be determined from the following equation:

$$I_{AVE} = \frac{\sum_{k=0}^{K-1} (k \times \text{Number of } k \text{ Pixels})}{\text{Total Number of Pixels in Image}} \tag{2}$$

where $I_{AVE}$ is the average brightness level of the image, k is a brightness level (in the depicted embodiment, the brightness (gray) levels range from 0 to 255), K is the greatest brightness level associated with the image (in the depicted embodiment, brightness (gray) level 255), Number of k Pixels is the number of pixels having a k brightness level, and Total Number of Pixels is the total number of pixels that form the image. Similar to each brightness level, the average brightness level is associated with a brightness percentage value. For the sake of example, it is assumed that the second intensity characteristic for the image represented in FIG. 3 is about 40%, which indicates that the average brightness of the image is at a 40% brightness level. The second intensity characteristic is designated as brightness level $N_2$ in FIG. 3, which corresponds with the 40% brightness level in the depicted embodiment. Alternatively, the average brightness level could be determined by an algorithm different than Equation (2). In yet another alternative, the second intensity characteristic could be the maximum brightness level of the image's pixel intensity distribution, the mean brightness level of the image's pixel intensity distribution, a value indicating a sharp rise or fall of the image's histogram curve of the pixel intensity distribution, or some other value. It should be noted that, similar to the first intensity characteristic, the second intensity characteristic will vary depending on each image's pixel intensity distribution and the method used to determine the second intensity characteristic.

At block 208, a difference between the first and second intensity characteristics is determined by the following equation:

$$\text{Difference} = \text{First Intensity Characteristic} - \text{Second Intensity Characteristic} \tag{3}$$

In the depicted embodiment, the difference (distance) between the first ($N_1$) and second ($N_2$) intensity characteristics is the difference between the first and second dimming ratios, which is about 50% (90%−40%=50%). As will be discussed in further detail below, the difference (distance)

between the first and second intensity characteristics (here, the first and second dimming ratios) provides a way to classify the image as a high brightness contrast image or a non-high brightness contrast image.

At block 210, the difference between the first and second intensity characteristics is compared to a threshold value. The threshold value is a minimum threshold value for detecting a high brightness contrast image. The threshold value is a programmable value that is stored by the high brightness contrast limit register (not illustrated) in the control register section 140. For the sake of example, in the depicted embodiment, the minimum threshold value for detecting a high brightness contrast image can be about 30%. The threshold value may be represented by variables other than the percentage illustrated. Further, since the threshold value is a programmable value, the threshold value for detecting high brightness contrast images can be set to any value depending on a desired sensitivity of the display device 100 to high brightness contrast images.

At block 212, it is determined whether the difference is equal to or greater than the threshold value. Here, the difference of the two intensity characteristics is 50% (determined at block 208), which is greater than the minimum threshold value of 30%. The image associated with the image histogram 300 of FIG. 3 is thus classified as a high brightness contrast image. At this point, it should be noted that high brightness contrast images exhibit a distinct pixel intensity distribution. That is, for a high brightness contrast image, the difference (distance) between the first ($N_1$) and second ($N_2$) intensity characteristics is large. Referring to FIG. 3, in the depicted embodiment, the high brightness contrast image illustrates a pixel group with a bright brightness value ($N_1$) and a pixel group with an average brightness value ($N_2$). From FIG. 3, it is clear that a brightness gap between $N_1$ and $N_2$ is fairly substantial. In contrast, images that are not high brightness contrast images will have pixel intensity distributions having a small difference (distance) between the first ($N_1$) and second ($N_2$) intensity characteristics. For example, the distance between two distinct pixel groups of the image is small. Accordingly, despite the pixel intensity distribution of an image, the distance between the first and second intensity characteristics (here, between the first and second dimming ratios) will indicate whether the image is a high brightness contrast image.

Figure 4:
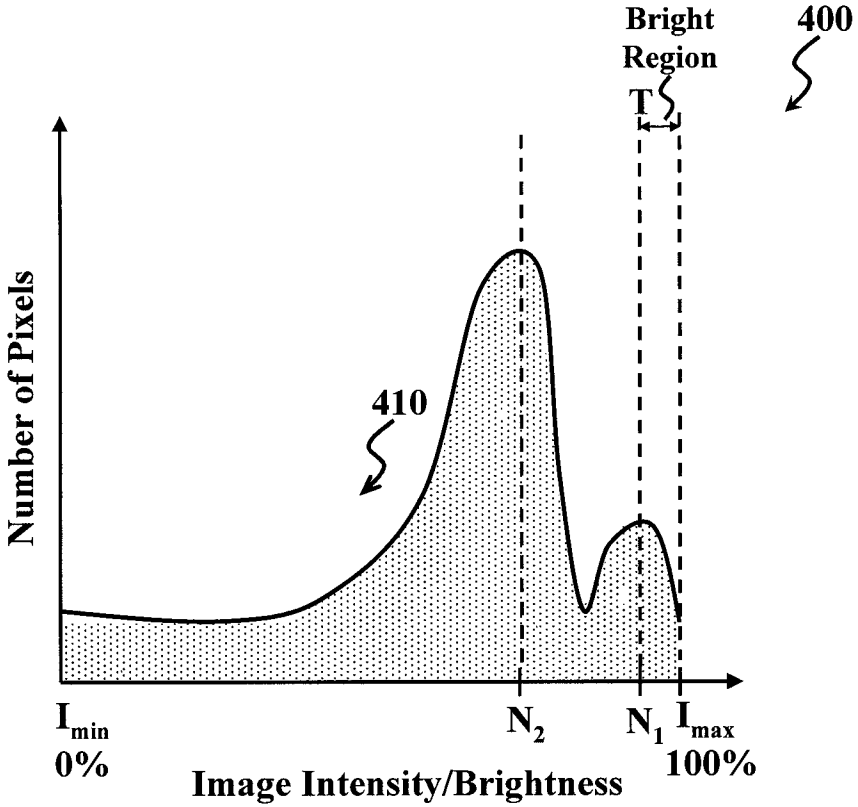

For example, FIG. 4 illustrates an image histogram 400 showing a curve 410 that illustrates a pixel intensity distribution of another image, which is not a high brightness contrast image. Similar to FIG. 3, in FIG. 4, a horizontal axis represents intensity (brightness/gray level) values of the pixels in the image from a minimum value to a maximum value, and the vertical axis represents the number of pixels. Each point in the curve 410 indicates a number of pixels in the image at a respective brightness level. Applying blocks 202 through 212 of method 200 to the image data associated with the image histogram 400 in FIG. 4, the image corresponding with image histogram 400 is classified as not a high brightness contrast image. The first intensity characteristic ($N_1$) is the lowest brightness level associated with the bright region of the image histogram 400. Assuming that the same bright region limit value (in the depicted embodiment, 5%) and high brightness contrast limit value (in the depicted embodiment, 30%) are used for evaluating the pixel intensity distributions of each image to be displayed on the display device 100, the first intensity characteristic ($N_1$) associated with image histogram 400 is about 85%. The second intensity characteristic ($N_2$) associated with image histogram 400 is the image's average brightness level, and for the sake of example, the second intensity characteristic determined from FIG. 4 is about 70%. The difference between the first and second intensity characteristics is 15% (85%−70%=15%). The difference of the two intensity characteristics of 15% is less than the threshold value of 30%, and thus, the image associated with image histogram 400 is classified as not a high brightness contrast image.

Figure 5:
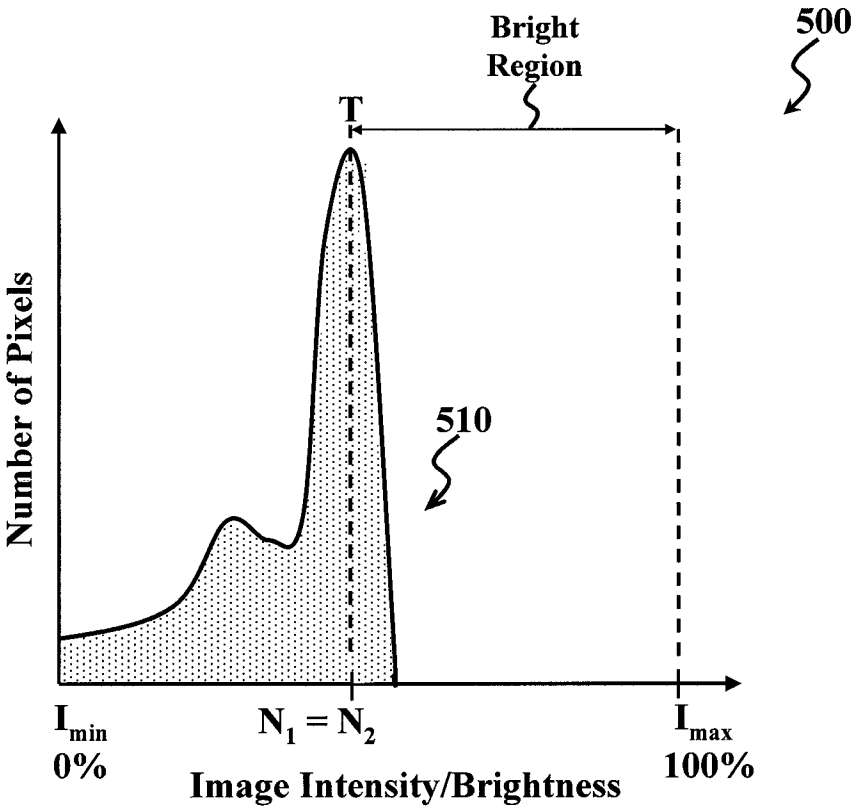

For another example, FIG. 5 is an image histogram 500 showing a curve 510 that illustrates a pixel intensity distribution of yet another image. Similar to FIG. 3, in FIG. 5, a horizontal axis represents intensity (brightness/gray level) values of the pixels in the image from a minimum value to a maximum value, and the vertical axis represents the number of pixels. Each point in the curve 510 indicates a number of pixels in the image at a respective brightness level. Applying blocks 202 through 212 of the method 200 to the image data associated with the image histogram 500 in FIG. 5, the image corresponding with the image histogram 500 is also not classified as a high brightness contrast image. For example, the first intensity characteristic ($N_1$) is the lowest brightness level associated with the bright region of the image histogram 500. Assuming that the same bright region limit value (in the depicted embodiment, 5%) and high brightness contrast limit value (in the depicted embodiment, 30%) are used for evaluating the pixel intensity distributions of each image to be displayed on the display device 100, the first intensity characteristic ($N_1$) associated with image histogram 500 is about 50%. The second intensity characteristic ($N_2$) associated with image histogram 500 is the image's average brightness level, and for the sake of example, the second intensity characteristic determined from FIG. 5 is also about 50%. The difference between the first and second intensity characteristics is 0% (50%−50%=0%), which is less than the minimum threshold value of 30%. The image associated with the image histogram 500 is thus classified as not a high brightness contrast image. Accordingly, from the foregoing, the difference between the first and second intensity characteristics provides a way to classify images to be displayed on the display device 100. More specifically, the difference (distance) between the two intensity characteristics can detect whether the incoming image is a high brightness contrast image so that a backlight control signal can be adjusted accordingly.

The foregoing discussion describes how the incoming image is classified. The following discussion will address determining the backlight control signal based on the incoming image's classification. Conventional backlight control methods typically set the backlight control signal (in other words, dimming ratio control signal 135 and backlight control signal 155) to the second intensity characteristic ($N_2$) whether the image is a high brightness contrast image or not. For example, in the depicted embodiment, even though the image associated with image histogram 300 is a high brightness contrast image, the backlight control signal would be set to 40% (the second intensity characteristic). Since the image associated with image histogram 300 includes a fairly large pixel group including higher brightness levels, setting the backlight control signal to the second intensity characteristic (based on the average brightness level of the image) can result in poor image quality. To compensate for the high brightness contrast image, the backlight control signal could be set to the first intensity characteristic ($N_1$), such as 90% in the depicted embodiment. However, though this will improve image quality, the display device's power savings can be degraded. More specifically, power savings of the display device 100 varies with the backlight control signal intensity. When the backlight control signal operates at 100%, the backlight section 160 is completely on, and the display device 100 achieves no power savings. When the backlight control signal does not operate at 100%, the backlight section 160 is not fully on, and the display device 100 achieves power savings. As a general rule, the percentage the backlight section 160 is not fully on is the percentage of power savings achieved by the display device 100. For example, if the backlight control signal is set to 65%, the backlight section is on 65% of the time, and thus, the power savings of the display device 100 is about 35%. The disclosed method 200 addresses these image quality and power savings issues by adjusting the dimming ratio if the image is a high brightness contrast image, as described in detail below.

Referring again to FIG. 2, in the depicted embodiment, since the difference of the first and second intensity characteristics was greater than the threshold value (indicating that the image associated with the image histogram 300 is a high brightness contrast image), the method 200 proceeds to block 214, where an adjusted backlight control signal is generated. More specifically, the backlight control signal is adjusted to compensate for the fact that the image is a high brightness contrast image. The adjusted backlight control signal corresponds with both the first and second intensity characteristics (more specifically, the first and second dimming ratios). In the depicted embodiment, an adjustment to the backlight control signal needs to be made to compensate for the high brightness contrast image. For example, an intensity adjustment amount is determined by the following equation:

$$\text{Intensity Adjustment Amount} = \text{Difference} \times \text{Compensation Value} \quad (4)$$

where the difference is the difference between the first and second intensity characteristics (determined at block 208). The compensation value is a programmable value that can be stored in the compensation value register (not illustrated) of the control register section 140. In the depicted embodiment, the compensation value is a ratio represented by a percentage. The ratio is referred to as a distance pass ratio. The following discussion refers to determining backlight control for the image associated with the pixel intensity distribution illustrated in FIG. 3. For the sake of example, in the depicted embodiment, the compensation value can be 50%, and thus, the intensity adjustment amount is 25% (50%×50%=25%). Other values for the compensation value can be used.

The intensity adjustment amount is then added to the second intensity characteristic (the second dimming ratio) to arrive at the adjusted backlight control signal, which is a backlight dimming ratio:

$$\text{Adjusted Backlight Control Signal} = \text{Adjustment Amount} + \text{Second Intensity Characteristic} \quad (5)$$

where adjustment amount is the intensity adjustment amount. In the depicted embodiment, the adjusted backlight control signal is 65% (25%+40%=65%). The adjusted backlight control signal value indicates a dimming level (dimming ratio control signal 135) for the backlight section 160. Accordingly, in the depicted embodiment, a duty cycle/ratio of the inverter 150 is set at 65% according to the adjusted backlight control signal, such that the backlight section 160 receives a duty cycle/ratio signal (backlight control signal 155) of 65%. The corresponding backlight intensity (light output) to the display section 180 is 65% when displaying the image associated with the image histogram 300 in FIG. 3. Because the backlight control signal has been adjusted from the conventional dimming ratio (for example, second intensity characteristic) to a dimming ratio that compensates for the image being a high brightness contrast image (in the depicted embodiment, from 40% to 65%), the method 200 improves picture quality for displaying images on the display device, while providing power savings.

Assuming the difference between the first and second intensity characteristics was less than the threshold value (for example, if the image has a pixel intensity distribution similar to that depicted in image histogram 500 in FIG. 5), the method 200 proceeds to block 216, where a backlight control signal is generated. For example, since the image is not a high brightness contrast image, no adjustment to the backlight control signal is necessary. More specifically, the backlight control signal is a backlight dimming ratio, and in the depicted embodiment, the backlight dimming ratio is equal to the second intensity characteristic (the second dimming ratio). Thus, referring again to the first and second intensity characteristics corresponding with image data associated with the image histogram 500 in FIG. 5, the backlight control signal would be 50% (Backlight Control Signal=Second Intensity Characteristic (Second Dimming Ratio)). The backlight control signal value indicates a dimming level (dimming ratio control signal 135) for the backlight section 160. Accordingly, in the depicted embodiment, a duty cycle/ratio of the inverter 150 would be set at 50% according to the backlight control signal, such that the backlight section 160 receives a duty cycle/ratio signal (backlight control signal 155) of 50%. The corresponding backlight intensity (light output) to the display section 180 is 50% when displaying the image associated with the image histogram 500 in FIG. 5.

Thus, the present disclosure provides a system and method for classifying images to be displayed on a display device and providing backlight control based on an image's classification. The present disclosure can prevent backlight control, such as the dimming ratios, from being too aggressive or too conservative, allowing compensation for high brightness contrast images while providing power savings. For example, instead of having a single dimming ratio for adjusting the backlight of the display device, the present disclosure proposes dual dimming ratios, one being applied to high brightness contrast images, and the other being applied to non-high brightness contrast images. Different embodiments may have different advantages, and no particular advantage is necessarily required of any one embodiment.

The terms "first" and "second" should not be interpreted to mean that the first intensity characteristic is determined prior to the second intensity characteristic. Instead, labeling the intensity characteristics as "first" and "second" is merely a way to emphasize that the first intensity characteristic of the image is different than the second intensity characteristic of the image. Further, although the first and second intensity characteristics are ratios in the described embodiment, alternative embodiments may implement other values or variables for representing the first and second intensity characteristics to classify the images. It is also understood that the backlight control signal for the classified images may be arrived at by other methods, so long as the backlight control signal is adjusted to compensate for the various image classifications.

The embodiments of the present disclosure can be implemented, for example, by computer-executable instructions or code, such as a program stored on a computer-readable medium, for execution by a computer or any other instruction execution system. The computer-readable medium can be an electronic, magnetic, optical, electromagnetic, infrared, a semiconductor system (or apparatus or device), or a propagation medium. A program can include routines, objects, components, data structures, and the like to perform particular tasks or implement particular data types. As used herein, the term "program" may connote a single program or multiple programs acting in concert, and may be used to denote applications, services, or any other type or class of program. Likewise, the terms "computer" and "computing device" as used herein include any device that electronically executes one or more programs, including but not limited to an application specific integrated circuit, a field programmable gate array, other programmable logic devices, other suitable microprocessor-based programmable devices or configurable circuits, or combinations thereof.

Upon reading this disclosure, those of skill in the art will appreciate still additional alternative designs or implementation details for the embodiments described herein. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus of the embodiments disclosed herein without departing from the spirit and scope thereof.

What is claimed is:

1. A method for determining characteristics of an image to be displayed on a display device, the method comprising:

determining a pixel intensity distribution of the image;

determining a first intensity characteristic of the image from the pixel intensity distribution, wherein determining the first intensity characteristic comprises:

defining a bright region of the pixel intensity distribution of the image; and determining a lowest brightness level corresponding with the bright region of the pixel intensity distribution, wherein the first intensity characteristic is the lowest brightness level;

determining a second intensity characteristic of the image from the pixel intensity distribution;

determining a difference between the first and second intensity characteristics; and if the difference is greater than or equal to a threshold value, classifying the image as a high brightness contrast image.

2. The method of claim 1 wherein the determining the second intensity characteristic includes determining an average brightness level of the image from the pixel intensity distribution of the image.

3. The method of claim 1 wherein:

the image includes a plurality of pixels, each of the plurality of pixels being associated with a brightness level; and the determining the pixel intensity distribution of the image includes determining a number of pixels associated with each brightness level.

4. The method of claim 3 wherein:

the determining the first intensity characteristic includes determining a first ratio; and the determining the second intensity characteristic includes determining a second ratio.

5. The method of claim 4 wherein the first ratio include the determined lowest brightness level corresponding with the bright region of the pixel intensity distribution as a brightness percentage.

6. The method of claim 4 wherein the determining the second ratio includes determining an average brightness level of the image from the pixel intensity distribution of the image, thereby determining an average brightness percentage of the image.

7. The method of claim 1 including:

if the image is a high brightness contrast image, generating a backlight control signal that corresponds with the first and second intensity characteristics; and if the image is not a high brightness contrast image, generating a backlight control signal that corresponds with the second intensity characteristic.

8. A method comprising:

determining a pixel intensity distribution of an image to be displayed on a display device that includes a backlight section;

determining a first intensity characteristic of the image from the pixel intensity distribution, wherein determining the first intensity characteristic comprises:

defining a bright region of the pixel intensity distribution of the image; and determining a lowest brightness level corresponding with the bright region of the pixel intensity distribution, wherein the first intensity characteristic is the lowest brightness level;

determining a second intensity characteristic of the image from the pixel intensity distribution;

determining a difference between the first and second intensity characteristics;

if the difference is less than a threshold value, generating a backlight control signal, such that the backlight section outputs light according to the backlight control signal; and if the difference is equal to or greater than the threshold value, generating an adjusted backlight control signal, such that the backlight section outputs light according to the adjusted backlight control signal.

9. The method of claim 8 wherein:

the image includes a plurality of pixels, each of the plurality of pixels being associated with a brightness level; and the determining the pixel intensity distribution of the image includes determining a number of pixels associated with each brightness level.

10. The method of claim 8 wherein the determining the second intensity characteristic includes determining an average brightness level of the image from the pixel intensity distribution of the image.

11. The method of claim 10 wherein the determining the difference between the first and second intensity characteristics includes determining a difference between the lowest brightness level corresponding with the bright region and the average brightness level.

12. The method of claim 11 wherein the generating the adjusted backlight control signal includes generating a backlight dimming ratio corresponding with the difference and the average brightness level.

13. The method of claim 12 wherein the generating the backlight dimming ratio corresponding with the difference and the average brightness level includes:

determining an adjustment amount based on the difference and an adjustment level;

and generating a backlight dimming ratio based on the adjustment amount and the average brightness level.

14. The method of claim 11 wherein the generating the backlight control signal includes generating a backlight dimming ratio corresponding with the average brightness level.

15. The method of claim 8 wherein:

the first intensity characteristic is a first dimming ratio and the second intensity characteristic is a second dimming ratio;

the determining the difference between the first and second intensity characteristics includes determining a difference between the first and second dimming ratios;

the generating the backlight control signal includes generating a backlight dimming ratio corresponding with the second dimming ratio; and the generating the adjusted backlight control signal includes generating a backlight dimming ratio corresponding with the first and second dimming ratios.

16. The method of claim 15 wherein the generating the backlight dimming ratio corresponding to the first and second dimming ratios includes:

determining an adjustment ratio based on an difference ratio and the difference between the first and second dimming ratios; and adding the adjustment ratio to the second dimming ratio to determine the generated backlight dimming ratio.

17. The method of claim 15 wherein the generating the backlight dimming ratio corresponding with the second dimming ratio includes setting the generated backlight dimming ratio to the second dimming ratio.

18. An apparatus comprising:

a display section for displaying an image;

a backlight section for outputting light to the display section; and a backlight control section in communication with the backlight section, such that the output of light from the backlight section is according to a backlight control signal, wherein the backlight control section is configured to:

determine a first intensity characteristic of the image to be displayed on the display device, wherein the first intensity characteristic is a lowest brightness level in a defined bright region in a pixel intensity distribution of the image, determine a second intensity characteristic of the image from the pixel intensity distribution, determine a difference between the first and second intensity characteristics, if the difference is less than the threshold value, generate a backlight control signal, such that the backlight section outputs light according to the backlight control signal, and if the difference is equal to or greater than a threshold value, generate an adjusted backlight control signal, such that the backlight section outputs light according to the adjusted backlight control signal.

19. The apparatus of claim 18 wherein:

the first intensity characteristic is a first dimming ratio and the second intensity characteristic is a second dimming ratio;

the determining the difference between the first and second intensity characteristics includes determining a difference between the first and second dimming ratios;

the generating the backlight control signal includes generating a backlight dimming ratio corresponding with the second dimming ratio; and the generating the adjusted backlight control signal includes generating a backlight dimming ratio corresponding with the first and second dimming ratios.

* * * * *